US006474938B2

(12) United States Patent
Dalton et al.

(10) Patent No.: US 6,474,938 B2
(45) Date of Patent: Nov. 5, 2002

(54) FUEL PUMP FOR GAS TURBINES

(75) Inventors: William H. Dalton, Amston; George L. Bennett, Hebron, both of CT (US)

(73) Assignee: Coltec Industries Inc, Charlotte, NC (US)

( * ) Notice: Subject to any disclaimer, the term of this patent is extended or adjusted under 35 U.S.C. 154(b) by 0 days.

(21) Appl. No.: 09/836,093

(22) Filed: Apr. 17, 2001

(65) Prior Publication Data

US 2001/0033791 A1 Oct. 25, 2001

Related U.S. Application Data

(60) Provisional application No. 60/197,550, filed on Apr. 17, 2000.

(51) Int. Cl.[7] ..... F04D 5/00

(52) U.S. Cl. ..... 415/55.1; 415/104; 415/170.1

(58) Field of Search ..... 415/55.1, 55.2, 415/55.3, 55.4, 104, 229, 170.1, 174.2; 417/423.12, 365

(56) References Cited

U.S. PATENT DOCUMENTS

| | | | | |
|---|---|---|---|---|
| 4,804,313 A | | 2/1989 | Nasvytis | 415/53 T |
| 5,265,996 A | | 11/1993 | Westhoff et al. | 415/52.1 |
| 5,415,521 A | | 5/1995 | Hufnagel et al. | 415/55.1 |
| 5,490,387 A | | 2/1996 | Bisson et al. | 60/734 |
| 5,885,065 A | | 3/1999 | Long | 418/1 |
| 5,913,657 A | | 6/1999 | Mollenhauer | 415/55.4 |
| 5,964,584 A | | 10/1999 | Lorentz | 418/73 |
| 6,048,101 A | * | 4/2000 | Rasmussen | 384/517 |
| 6,135,730 A | * | 10/2000 | Yoshioka | 415/55.1 |

FOREIGN PATENT DOCUMENTS

| | | |
|---|---|---|
| DE | 24 05 112 | 8/1975 |
| DE | 43 15 448 A1 | 12/1993 |
| EP | 0 070 529 A1 | 1/1983 |
| EP | 0 397 041 A2 | 11/1990 |
| EP | 0 677 661 A1 | 10/1995 |

* cited by examiner

*Primary Examiner*—Edward K. Look
*Assistant Examiner*—Kimya N. McCoy
(74) *Attorney, Agent, or Firm*—Cummings & Lockwood LLC; David J. Silvia

(57) ABSTRACT

A fuel pump for use in conjunction with a gas turbine engine is disclosed which includes a pump housing, a shrouded rotor member, and an inlet post member, wherein fluid is axially supplied along the pump centerline and then radially discharged at a first pressure to the interior chamber of the pump housing, at the base portion of vane elements associated with the rotor, thereby contacting the vane elements at a minimum angular velocity and angle of incidence. Also disclosed is a single bearing arrangement for eccentrically supporting a shrouded rotor member.

26 Claims, 4 Drawing Sheets

FUEL PUMP FOR GAS TURBINES

CROSS-REFERENCE TO RELATED APPLICATIONS

This application claims priority to U.S. Provisional Patent Application No. 60/197,550, filed Apr. 17, 2000, which is herein incorporated by reference in its entirety.

BACKGROUND OF THE INVENTION

1. Field of the Invention

The subject application relates to fuel delivery systems, and more particularly, to a fuel pump for use in conjunction with gas turbine engines.

2. Background of the Related Art

Conventional fuel delivery systems utilize a fuel pump to transfer fuel from a storage tank or reservoir to an engine. Gas turbine engines used in aircraft require the fuel pump to supply the fuel at a high pressure. Limitations inherent in the design of some aircraft, such as helicopters where the engines are located several feet above the fuel tank, result in the delivery of fuel from the reservoir to the inlet of the fuel pump at a relatively low pressure. As a result, the fuel pump used in aircraft applications must be capable of operating under low inlet pressure conditions while supplying fuel at the required high pressure.

In an effort to meet the performance demands placed on aircraft fuel delivery systems, the practice of using an inlet pressure boost pump in conjunction with a main fuel pump has been developed. Typically, the main fuel pump is a high pressure pump such as a gear pump. The main fuel pump receives fuel from the inlet boost pump and supplies high pressure fuel to the gas turbine engine. The boost pump is a low pressure pump which receives fuel from the supply reservoir or fuel tank, increases the pressure of the fuel, and then discharges the fuel to the inlet of the main fuel pump. The function of the boost pump is to adequately charge the high-pressure pump even when the boost pump is subjected to poor inlet conditions such as low Net Positive Suction Pressure (NPSP) and/or high Vapor to Liquid (V/L) ratio.

NPSP corresponds to the absolute pressure of the fuel or liquid at the pump inlet expressed in feet of liquid, plus velocity head, minus the vapor pressure of the fluid at pump temperature, and corrected to the elevation of the pump centerline in the case of horizontal pumps or to the entrance of the impeller for vertical pumps. $NPSP_{required}$ is determined by the pump manufacturer and is a function of pump speed and pump capacity. $NPSP_{available}$ represents the energy level of the fluid over the vapor pressure at the pump inlet and must be at least equal to the sum of the resistances to flow as follows: (1) the vapor pressure of the liquid in the pump chamber; (2) the suction lift when the liquid level is below the pump level; (3) the pressure required to lift the suction valve and overcome the resistance of its spring; (4) the liquid friction in the suction pipeline; (5) the forces required to accelerate the liquid in the suction pipeline; and (6) hydraulic losses in the pump. Unless the $NPSP_{available}$ is at least equal to the $NPSP_{required}$ during any operating condition, cavitation will occur. The V/L ratio corresponds to a two-phase inlet flow and equals the ratio of vapor to liquid fuel.

For fixed wing aircraft, a typical minimum NPSP value is 5.0 psid and a typical value for the maximum V/L ratio is 0.45. These requirements are often satisfied with a simple boost pump design that includes an inducer and a centrifugal impeller.

In recent years, side channel pumps such as the model EMC-91 boost stage pump manufacture by Chandler Evans Control Systems of West Hartford, Conn. or similar pumps to that shown in U.S. Pat. No. 4,804,313, which is herein incorporated by reference, have been used as boost-stage pumps in aircraft fuel delivery systems, because they have several performance, size, and weight features attractive to these demanding applications. In particular, side channel pumps perform well under adverse inlet conditions, such as low NPSP and high V/L ratio. Additionally, side channel pumps are self-priming. Thus, they are able to pump large air bubbles without having an adverse effect on pumping efficiency or fluid pressure. Air bubbles are a common problem in helicopter applications as a result of the engines being located approximately six feet above the fuel tank.

However, state-of-the-art helicopter applications have increased the demand on the boost pump and require the pump to handle a bubble mixture flow and an alternating liquid/air flow containing air bubbles as long as twelve inches. This corresponding to an NPSP as low as 1.0 psid and V/L ratio as high as 1.0. Although these requirements can be achieved with conventional side-channel pumps, obtaining these performance goals is a difficult proposition, and when achieved, very little performance margin is available.

The operation of conventional side channel pumps is well understood by those skilled in the art. In general, the fuel enters the pump chamber through side entrance port(s) which axially direct fuel flow into the impeller. The rotation of the impeller within the chamber creates a forced vortex flow pattern therein. Typically, two side channels are adjacent to the rotor chamber about an arc centered at zero degrees. Within this arc, circulating flow enters the channels and establishes a helico-toroidal flow pattern. As a result, the fluid passes through the impeller blades a number of times on its path from the inlet region to the discharge region. Each passage through the blades may be regarded as a conventional stage of head generation, and therefore the equivalent pressure rise of a multi-stage pump is achieved in one revolution of the rotor.

In order to maximize the performance of a pumping element such as a side channel pump, it is important for fuel to enter the pumping element at the lowest possible velocity. Generally, the angular velocity of a rotating element, such as a pump rotor or impeller, is directly proportional to the distance from the center of rotation. Therefore, the lowest angular velocity of a rotating impeller blade, is located at the base of the blade and the highest velocity occurs at the blade tip.

As stated, conventional side channel pumps supply fuel axially through an inlet port(s) disposed within the side of the pump housing, parallel to the axis of rotation. Thus, the supplied fuel has to pass the rotor blades at a velocity proportional to the distance between the port and the center of rotation. This results in a degradation of NPSP and V/L performance because of the high blade speed, especially at the outermost radius of the inlet port.

Another problem associated with conventional side-channel pump design is that the configuration of the impellers is less than optimal, from a performance perspective. More specifically, side channel pumps commonly utilize paddle-wheel type impellers or impellers having blades which are for the most part two-dimensional and positioned radially perpendicular to the impeller rotation. This type of blade is typically selected because it is easy to manufacture. However, NPSP and V/L performance is dependent on incidence angle between the blade surface and the direction of the inlet fuel flow. Therefore, the performance of a paddle-wheel impeller is less than optimal, because the flow entering the pumping chamber axially through the side port(s) is not in angular alignment with the blades.

In response to these difficulties, several NPSP and V/L performance improvements have been made with side channel pumps having impellers designed with blades angled with respect to the direction of rotation, partially rectifying the incidence problem. However, these designs are unpopular because they are difficult and expensive to manufacture.

Another problem associated with conventional side-channel pump configurations is that at times the radial space desired for the inlet port, which is a function of the desired inlet flow rate, and the side channel are greater than the radial space available. As a result, the pump designer is forced to reduce the size of the inlet port and/or side channel below the optimum, corresponding to a reduction in pump performance.

As mentioned previously, the requirement to maximize performance of the fuel pump is married to the goal of achieving lightweight and compact designs in the aerospace industry without sacrificing aircraft performance. Whether a side channel pump is used in the fuel delivery system or another close clearance pump design is selected, pump performance can be improved by minimizing both the axial and radial clearance between the impeller and the inlet port and rotor housing. Clearances between the inlet port(s) and the impeller blades are critical and must be minimized to reduce leak paths. These clearances are typically controlled by two axial thrust bearings. Also, critical to the reduction of leak paths is the axial clearance between the impeller and the pump housing. Standard pump designs utilize two large journal bearings located on each end of the rotor. This arrangement evenly distributes the weight of the rotor and the forces generated by the pumping action between the two bearings. The rotors alignment within the pump housing is controlled by the radial clearance between the inside diameter of the journal bearing and the outside diameter of the rotor shaft. The rotor freely can move within these clearances.

In most rotary pump applications, the inlet area needs to be maximized in order to minimize hydraulic losses due to friction and bending. As a result, the journal bearings tend to be large since the inlet must be accommodated inside of the journal bearings. These large bearings require large clearances which conflict with the need for minimizing the radial clearances in the inlet of a center feed device. Since rotor elements typically float within the clearances of the journal bearings, the clearance between the inlet and the rotor is for the most part equivalent to the bearing clearances.

Additionally, as noted, conventional side channel pumps utilize an axial discharge port located in the side of the pump housing, offset from the central axis. The side discharge port is connected to the fuel line leading to the main pump or engines. If a central discharge port could be provided, the space requirements for the pump could be significantly reduced.

There is a need, therefore, for a new fuel pump configuration which cost effectively improves the NPSP and V/L performance by reducing the velocity and incidence at which the fuel contacts the impeller blades and thereby increases the performance margin available for state-of-the art fuel delivery systems. There is also a need for a fuel pump design which reduces leakage losses and maximizes performance of the aircraft pumping elements by minimizing both the axial and radial clearances between the impeller and the inlet port(s) and rotor housing.

SUMMARY OF THE INVENTION

The subject application is directed to a new and useful fuel pump for gas turbine engines, and more particularly, to a side channel fuel pump which includes a pump housing having an interior chamber and a discharge port, a rotor member mounted for rotational movement within the interior chamber, and an inlet post member supported within the pump housing for providing fluid to the interior chamber of the pump housing.

The interior chamber of the pump housing defines a central axis for the pump and laterally opposed arcuate channels extending about the central axis. The rotor member, which is disposed within the interior chamber, has a main body portion that includes circumferentially spaced apart radial vane elements, with each vane element having a radially inner base portion and a radially outer tip portion. The rotor member also has a mounting portion for supporting the rotor member within the interior chamber.

The inlet post member has opposed first and second end portions and defines an inlet passage extending between an inlet port associated with the first end portion and a radial discharge port associated with the second end portion. In operation, fluid is admitted into the inlet passage and is delivered at a first pressure radially to the interior chamber of the pump housing at the base portion of the of vane elements. Once the fluid is received into the interior chamber, rotation of the rotor member within the chamber increases the pressure of the fluid, such that the fluid exits the interior chamber at a second pressure through the discharge port of the pump housing.

Preferably, the discharge port of the pump housing extends axially from the interior chamber and is offset from the central axis of the pump. Additionally, the fuel pump further comprises three bearings for supporting the rotor member and maintaining alignment of the rotor member within the interior chamber. The bearings include a journal bearing operatively associated with the mounting portion for maintaining the radial position of the rotor member, and first and second axial thrust bearings for maintaining the axial position of the rotor member.

It is envisioned that the fuel pump of the subject application further comprises a circumferential biasing means disposed within the interior chamber of the pump housing for biasing the first axial thrust bearing towards the rotor member, so as to promote static equilibrium within the housing and axial alignment of the rotor member. In one embodiment, the circumferential biasing means comprises an annular wave washer. The wave washer can have a sinusoidal or tapered cross section which flattens in order to provide the desired stiffness or adjustment capability. Alternatively, the circumferential biasing means comprises a plurality of helical springs. It is envisioned that, the circumferential biasing means further includes at least one shim element for adjusting a biasing force applied by the circumferential biasing means.

In an embodiment, the fuel pump further includes a circular plate member axially mounted for movement within the interior chamber of the pump housing. The plate member is disposed between the main body portion of the rotor member and the first axial thrust bearing and is adapted to restrict the flow of fluid within the interior chamber of the pump housing.

In an embodiment of the subject invention, the inlet post member is dimensioned and configured in such a manner so that an initial close clearance fit exist between the inlet post and the rotor. During the break-in period of the pump, the rotor machines the outer surface of the inlet post so as to create a running clearance between the two components. Thus, the rotor is not supported on the inlet post. Rather, it is axially supported by the axial thrust bearings.

The subject application is also directed to a fuel pump which includes a pump housing having an interior chamber which defines a central axis for the pump and a discharge port. The interior chamber also defines laterally opposed arcuate channels extending about the central axis. The fuel pump further includes a rotor member mounted for rotational movement within the interior chamber and having a main body portion that includes circumferentially spaced apart radial vane elements. The rotor also includes a mounting portion supporting the rotor member within the interior chamber and having an axial discharge passage extending therethrough.

In this embodiment it is envisioned that an inlet post member is supported within the pump housing. The inlet post member has opposed first and second end portions and defines an inlet passage and a outlet passage. As in the previous embodiment, the inlet passage extends between an inlet port associated with the first end portion and a radial discharge port associated with the second end portion. In this embodiment, an outlet passage is associated with the second end portion and it extends between a radial intake port and an axial discharge port. In a manner similar to that of the previously disclosed embodiment, fluid is admitted into the inlet port and is radially delivered at a first pressure to the interior chamber of the pump, wherein the pressure is increased. The rotor member then increases the pressure of the fluid within the interior chamber. Unique to this embodiment, the fluid exits the pump housing at a second pressure through the outlet passage which is associated with the inlet post member.

It is also envisioned that a single journal bearing is operatively associated with the mounting portion of the rotor, and first and second axial thrust bearings are disposed within the interior chamber of the pump housing for maintaining the axial position of the rotor member along with circumferential biasing means.

The subject application is further directed to a pump housing having an interior chamber and a discharge port, with the interior chamber defining a central axis for the pump. A rotor member is mounted for rotational movement within the interior chamber about the central axis, and the rotor member has a main body portion that includes circumferentially spaced apart radial vane elements and a mounting portion for supporting the rotor member within the interior chamber. A journal bearing is operatively associated with the mounting portion for supporting for the rotor member within the housing, and first and second axial thrust bearings are disposed within the interior chamber of the pump housing for maintaining the axial position of the rotor member within the interior chamber of the pump housing. Circumferential biasing means are disposed within the interior chamber of the pump housing for biasing the first axial thrust bearing towards the rotor member so as to promote static equilibrium of forces within the pump housing.

The subject application is additionally directed to a pump housing having an interior chamber and a discharge port. An impeller is mounted for rotational movement within the interior chamber of the pump housing. The impeller has a main body portion and a cantilevered cylindrical extension portion for supporting the impeller within the interior chamber. The cantilevered cylindrical extension portion has an axial discharge passage extending therethrough. An inlet post member is supported within the pump housing, and it has opposed first and second end portions that define an inlet passage and a outlet passage, respectively. A journal bearing is operatively associated with the cantilevered cylindrical extension portion for supporting for the impeller within the housing. Additionally, first and second axial thrust bearings are disposed within the interior chamber of the pump housing for supporting the impeller. Preferably, an annular wave washer is disposed within the interior chamber of the pump housing for biasing the first axial thrust bearing toward the impeller so as to facilitate static equilibrium within the pump housing by restoring the bending moment exerted by the cantilevered extension portion of the impeller. Also, at least one shim element is provided for adjusting the biasing force applied by the wave washer.

Those skilled in the art will readily appreciate that the disclosure of the subject application provides a new fuel pump configuration which effectively improves the NPSP and V/L performance by reducing the velocity and incidence at which the fuel contacts the impeller blades and thereby increases the performance margin available for state-of-the art fuel delivery systems. The subject disclosure also provides a fuel pump configuration which reduces leakage losses and maximizes performance of aircraft pumping elements by minimizing both the axial and radial clearances between the impeller and the inlet port(s) and rotor housing.

These and other unique features of the fuel pump disclosed herein will become more readily apparent from the following description, the accompanying drawings and the appended claims.

BRIEF DESCRIPTION OF THE DRAWINGS

So that those having ordinary skill in the art to which the present application appertains will more readily understand how to make and use the same, reference may be had to the drawings wherein.

These and other features of the subject invention will become more readily apparent to those having ordinary skill in the art form the following detailed description of the preferred embodiments.

DETAILED DESCRIPTION OF PREFERRED EMBODIMENTS

The present invention overcomes several of the problems associated with prior art fuel pumps used in conjunction with gas turbine engines. The advantages, and other features of the fuel pump disclosed herein, will become more readily apparent to those having ordinary skill in the art from the following detailed description of the preferred embodiments taken in conjunction with the drawings which set forth representative embodiments of the present invention.

Figure 1:
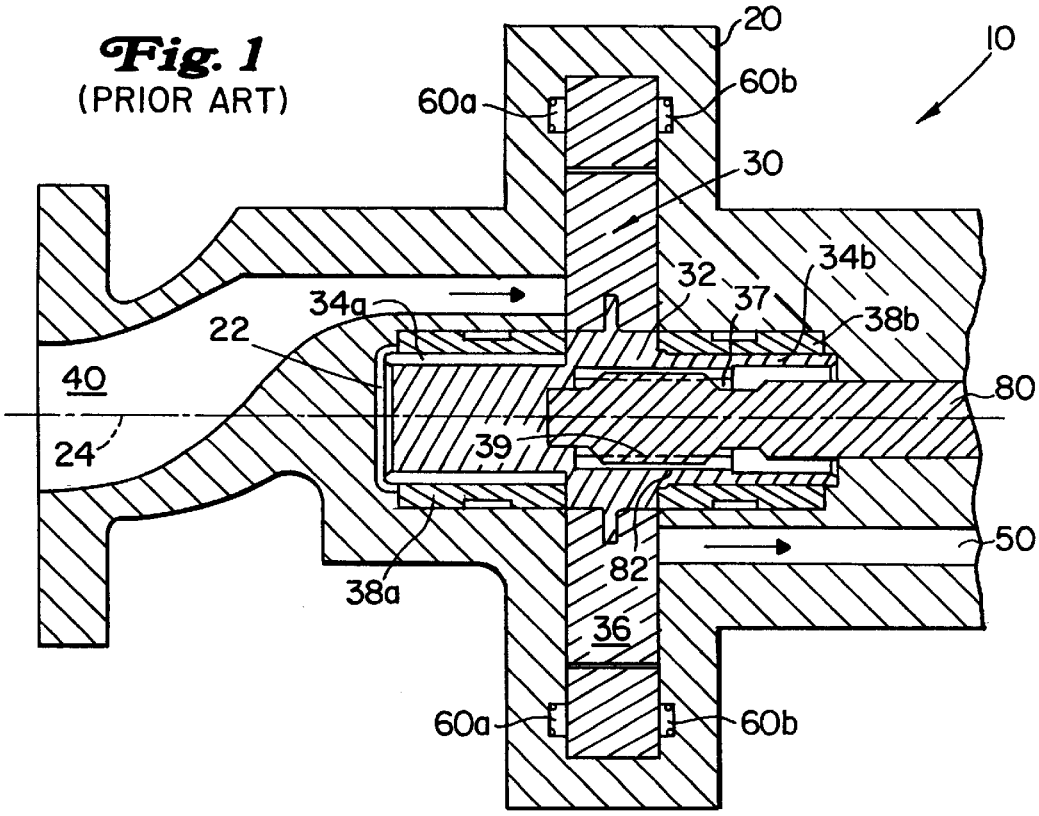
Fig. 1 (PRIOR ART)
FIG. 1 is a side elevation view in cross-section of a prior art side channel pump taken along the longitudinal axis of the pump.

Referring now to the drawings wherein like reference numerals identify similar structural elements of the subject invention, there is illustrated in FIG. 1 a prior art fuel pump for use as a boost stage pump in fuel delivery systems which is designated generally by reference numeral 10. Fuel pump 10 represents a conventional side channel pump design that includes a pump housing 20 and a rotor 30. The pump housing 20 has an interior chamber 22 in which rotor 30 is disposed. The interior chamber 22 defines a central axis 24 and two laterally opposed arcuate channels 60*a* and 60*b*, which extend partially about central axis 24.

The rotor 30 is mounted for rotational movement about central axis 24 within the interior chamber 22 of pump housing 20. The rotor 30 includes a main body portion 32 that has a plurality of blades 36 associated therewith and opposed mounting portions 34*a* and 34*b* for supporting the rotor 30 within the interior chamber 22. Journal bearings 38*a* and 38*b* are operatively associated with mounting portions 34*a* and 34*b*, respectively, for supporting the rotational movement of rotor 30 within interior chamber 22. Journal bearings 38*a* and 38*b* operate to evenly distribute the weight of rotor 30 and the forces generated during the pumping action. Rotor 30 operates within fixed clearances which are defined both radially and axially by journal bearings 38*a* and 38*b*.

In operation fuel enters the interior chamber 22 of pump 10 through side entrance port 40, which is offset from central axis 24. Side entrance port 40 axially directs fuel flow into blades 36. Drive shaft 80 is disposed within rotor cavity 37 and is operatively connected thereto by male gear 82 which mates with corresponding female gear 39 associated with rotor 30. Drive shaft 80 effects rotation of rotor 30 within the interior chamber 22, thereby creating a forced vortex flow pattern therein. Laterally opposed side channels 60*a* and 60*b*, are located adjacent to interior chamber 22, and extend about an arc centered at zero degrees. Within this arc, circulating flow enters channels 60*a* and 60*b* and establishes a helico-toroidal flow pattern. As a result, fluid passes through blades 36 several times on its path from the inlet region of the interior chamber 22 to the discharge region. Each passage of the fluid through blades 36 increases the energy imparted to the fluid, thereby increasing the fluid velocity, which is recovered in the form of increased fluid pressure. This pressurized fluid then exits pump 10 through radial discharge port 50, which is also offset from central axis 24.

As noted above, pump 10 supplies fuel axially through inlet port 40 disposed within the side of pump housing 20, parallel to central axis 24 and therefore, the axis of rotation. Thus, the supplied fuel passes the blades 36 at a velocity proportional to the radial distance of port 40 from the central axis 24. As noted previously, this results in a degradation of NPSP and V/L performance due to the angle of incidence between the fluid entering the interior chamber 22 via inlet port 40 and the angle of blades 36. Also, the configuration of pump 10 further degrades NPSP and V/L performance due to the high blade speed at the point the fluid enters interior chamber 22, especially at the outermost radius of inlet port 40.

Figure 2:
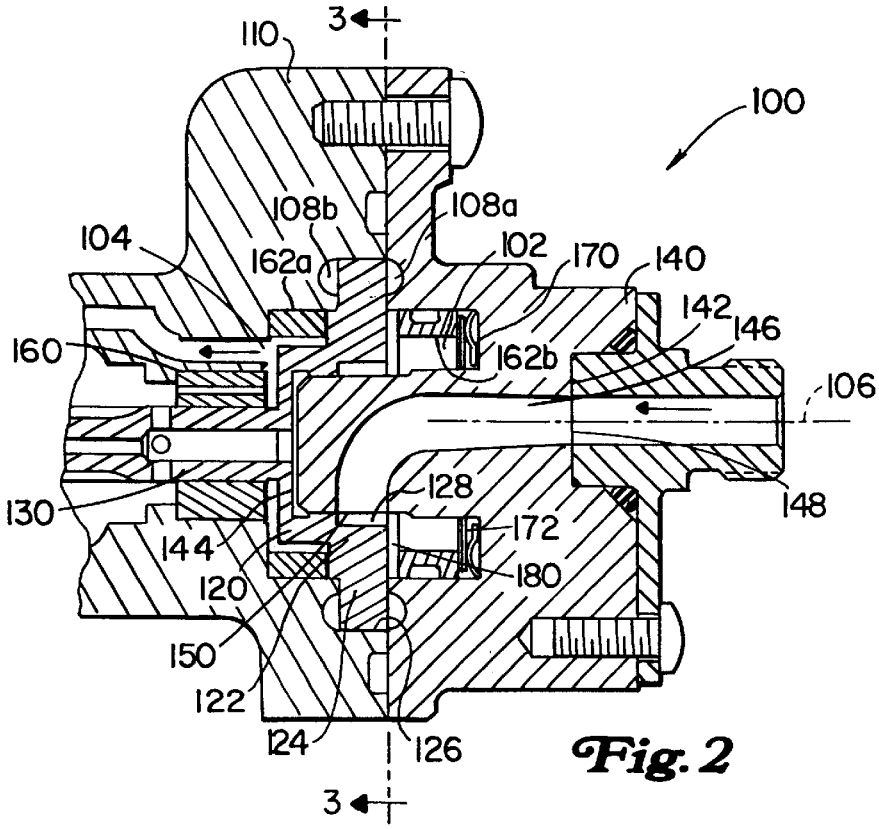
FIG. 2 is a side elevation view in cross-section of a side channel pump constructed in accordance with a preferred embodiment of the subject application, which includes a pump housing having a interior chamber, an inlet port, a discharge port, a rotor member, and a single journal bearing for supporting the rotor within the interior chamber, wherein the inlet port supplies fluid radially to the interior chamber.

Referring now to FIG. 2, there is illustrated a fuel pump constructed in accordance with a preferred embodiment of the subject application and designated generally by reference numeral 100. Pump 100 is a side channel pump that includes a pump housing 110, a rotor member 120 and an inlet post member 140. In this embodiment of the subject application, pump housing 110 includes an interior chamber 102 and a discharge port 104. The interior chamber 102 defines a central axis 106 for pump 100 and laterally opposed arcuate channels, 108*a* and 108*b* which extend partially about central axis 106 through approximately 270 degrees. Rotor member 120 is mounted for rotational movement within the interior chamber 102 of pump housing 110 about central axis 106. The rotor member 120 has a main body portion 122 and a mounting portion 130 for supporting the rotor member 120 within interior chamber 102. The main body portion 122 includes circumferentially spaced apart radial vane elements 124, each having a radially inner base portion 128 and a radially outer tip portion 126.

Inlet post member 140 is supported within pump housing 110 and has opposed first and second end portions 142 and 144 and defines an inlet passage 146. The inlet passage 146 extends between an inlet port 148 associated with the first end portion 142 and a radial discharge port 150 associated with the second end portion 144. Preferably, inlet post member 140 is dimensioned and configured in such a manner so that an initial close clearance fit exist between the outer surface of the inlet post member and the corresponding mating surface of the rotor. During the break-in period of the pump, when the pump is gradually brought up to nominal speed, the mating surface of the rotor, which is constructed from hardened steel, machines or wears away the outer surface of the inlet post member so as to create a running clearance between the two components.

In operation, fluid is supplied from a fuel tank (not shown) to inlet port 148 and is delivered at a first pressure axially with respect to central axis 106 along inlet passage 146. Inlet passage 146 then traverses radially outward toward interior chamber 102 of the pump housing 110. The transition from axial flow to radial flow in inlet passage 146 is configured to minimize the pressure and velocity losses normally associated with changes in flow direction, while maintaining as small a bend radius as possible. It is preferred that the bend radius be minimized thereby allowing the base portion 128 of vane elements 124 to be as close as possible to central axis 106, and thereby enabling the base portion 128 to travel at a minimum angular velocity.

Figure 3:
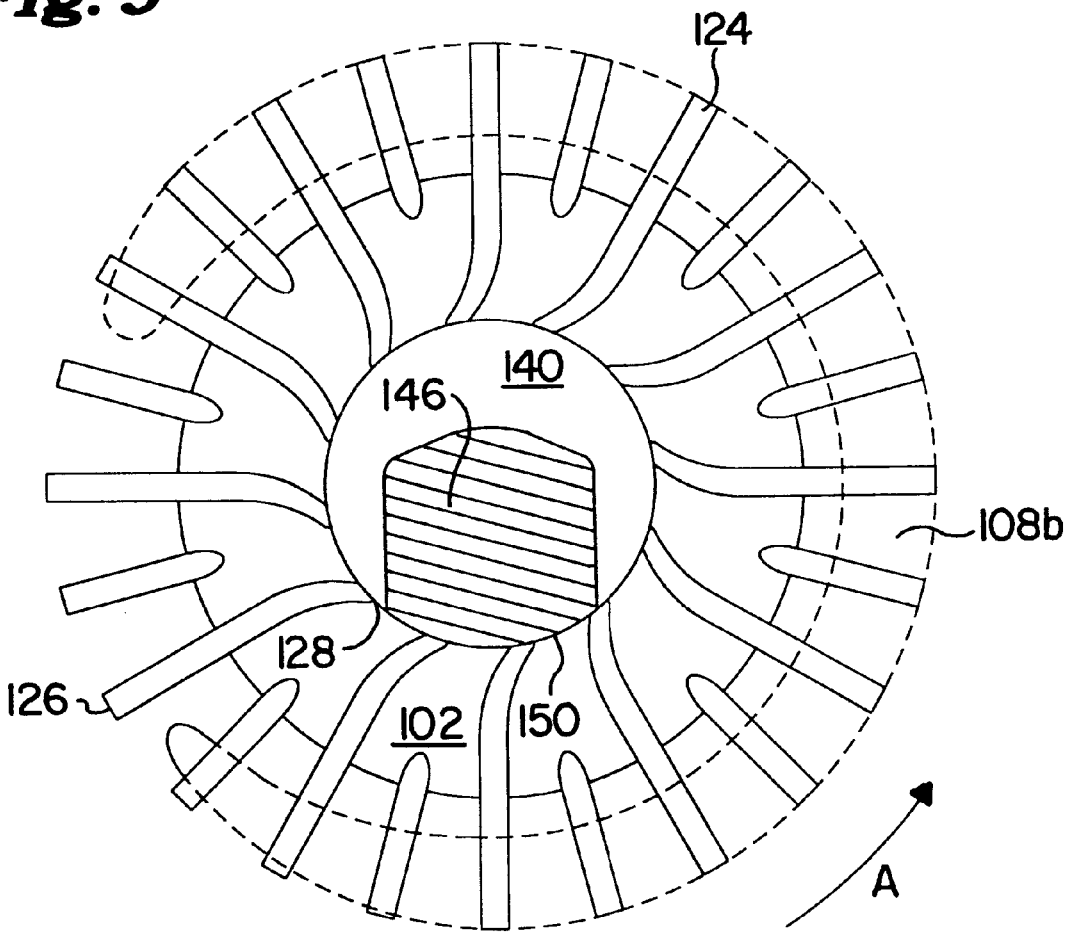
FIG. 3 is a cross-sectional view taken along line 3—3 of FIG. 2 illustrating the spaced apart radial vane elements of the rotor member, an inlet passage extending through an inlet post member, and an arcuate side channel extending about the pump axis.

Referring to FIG. 3, after traversing inlet passage 146, fluid exits through radial discharge port 150 into the interior chamber 102, at the base portion 128 of vane elements 124. In this configuration, improvements in NPSP and V/L performance over the prior art are achieved by allowing fluid to be supplied to interior chamber radially at the base portion 128 of vane elements 124, where blade speed is at its lowest. Also, this "center feed" configuration, allows the incidence angle between the flow direction and the blade surface to be further optimized by using a two-dimensional impeller profile. The fuel pump disclosed herein is capable of operating with a relatively low inlet pressure and is capable of producing an outlet pressures suitable for most applications.

Referring to FIGS. 2 and 3, the rotation of a drive shaft (not shown) effects rotation of rotor member 120 within the interior chamber 102 as indicated by directional arrow A. The rotation of rotor member 120 within interior chamber 102 creates a forced vortex flow pattern therein. Laterally opposed side channels 108*a* and 108*b* are located adjacent to interior chamber 102 about an arc centered at zero degrees. Within this arc, circulating flow enters channels 108*a* and 108*b* and establishes a helico-toroidal flow pattern. As a result, fluid passes through blades 124 several times on its path from the inlet region of the interior chamber 102 to the discharge region. Each passage through blades 124 imparts energy to the fluid, thus increasing the flow velocity, which is recovered as an increase in the fluid pressure. Then, the pressurized fluid exits the pump 100 through radial discharge port 104, which is offset from central axis 106.

Blades 124 shown herein have a two-dimensional profile in that they are contoured only in a single plane (see FIG. 3). Blades 124 are curved at the base portion 128 to facilitate receiving the incoming fluid. However, it is further envisioned that blades 124 can be configured to have a complex 3-dimensional profile or 2-dimensional profile having a flat base portion 128 or a purely radial blade. It has been shown that NPSP and V/L ratio performance can be optimized with a 3-dimensional profile in which blade 124 is contoured at the base portion 128 to a first angle to improve suction and V/L characteristics, then transitions to a second angle at the tip portion 126 to improve pumping pressure and efficiency performance.

With continuing reference to FIG. 2, which illustrates a fuel pump configuration in which flow enters the interior chamber radially through radial discharge port 150. The radial flow direction serves to minimize the incidence angle between blades 124 and the incoming fluid. In alternate applications, it may be desired to add an axial component to the entrance velocity, thereby affecting a "mixed flow" entrance condition. Preferably this can be achieved by providing an inlet post member that has a conical configuration with blades having a similarly angled base portion. Discharge port 104 of the rotor housing 110 extends axially from the interior chamber 102 and is offset from the central axis 106 of pump 100. Alternatively, discharge port 104 can be located along the central axis of pump 100, as will be discussed in more detail herein below with reference to FIGS. 4 and 5.

Preferably, rotor member 120 is supported within interior chamber 102 by an arrangement of bearings. The operation of the bearing system will also be discussed in more detail hereinbelow with reference to FIGS. 4 and 5. The bearing configuration includes a journal bearing 160 that is operatively associated with mounting portion 130 for supporting for the rotor member 120. Additionally, first and second axial thrust bearings 162*a* and 162*b* are provided. The axial thrust bearings 162*a* and 162*b* function to maintain the axial position of rotor member 120 within interior chamber 102. The arrangement of bearings further includes a circumferential biasing mechanism 170 and at least one shim element 172 disposed within interior chamber 102. The biasing mechanism promotes static equilibrium within the pump housing by urging the second axial thrust bearing 162*b* towards rotor member 120, and facilitates the axial alignment of rotor member 120.

In one embodiment of the invention, the circumferential biasing mechanism takes the form of an annular wave washer, and in an alternate embodiment a plurality of helical springs. As shown herein, circumferential biasing mechanism 170 is a wave washer having generally a sinusoidal profile. A wave washer with a linear profile can be substituted and would adequately provide the desired biasing force. Preferably, the circumferential biasing means is manufacture from a corrosion resistant steel. It is envisioned that the circumferential biasing means is capable of providing a suitable restoration force. However, those skilled in the art will appreciate that biasing elements with differing load characteristics can be utilized depending on the pumping application and performance requirements.

With continuing reference to FIG. 2, circular plate member 180 is axially mounted for movement within the interior chamber 102 of the pump housing 110, and is preferably mounted to the rotor for movement therewith. The plate member 180 is disposed between the rotor member 120 and the second axial thrust bearing 162*b* and is adapted to restrict the flow of fluid within interior chamber 102. Circular plate member 180 acts as a shroud, thereby improving air pumping performance by reducing pump losses.

Figure 4:
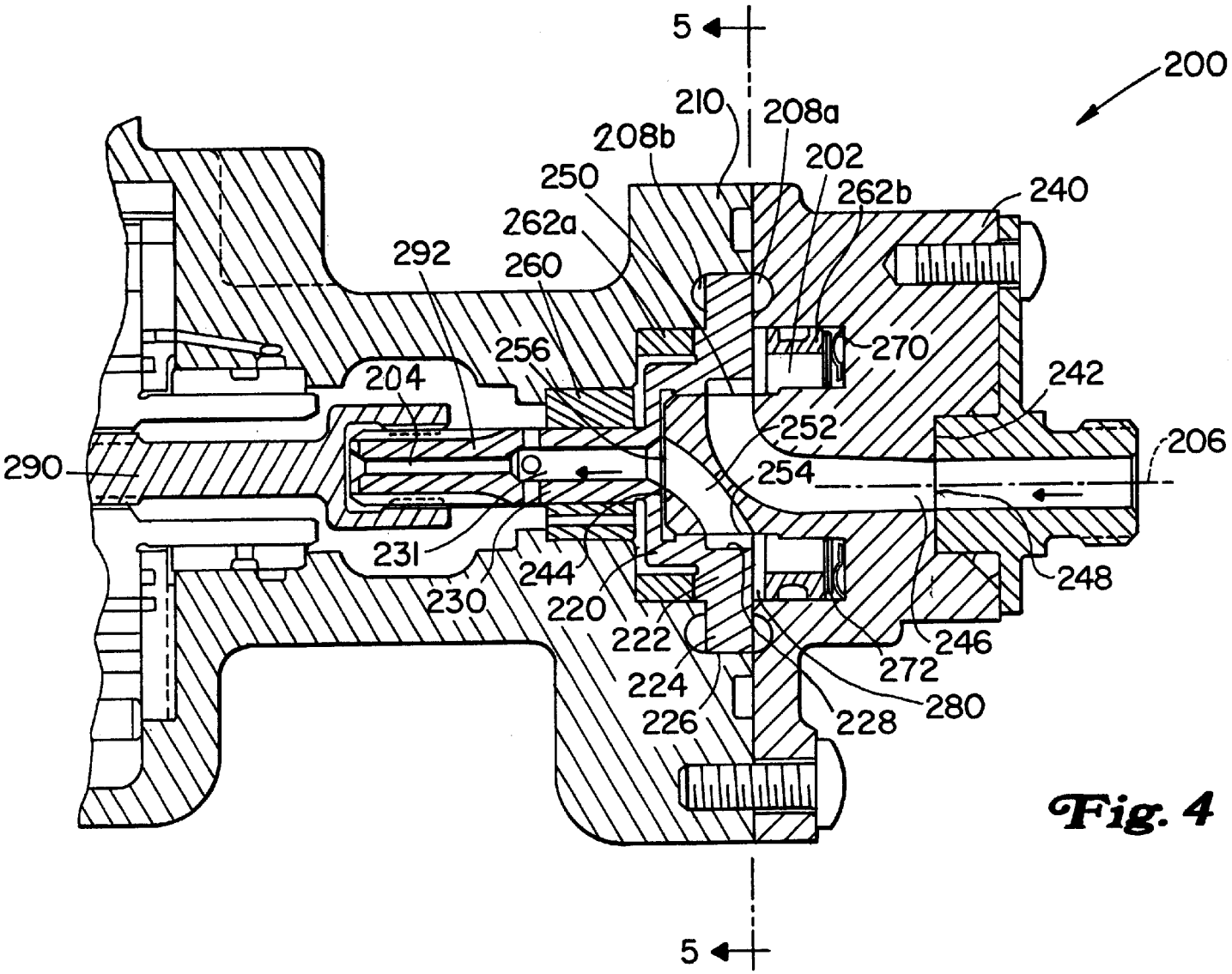
FIG. 4 is a side elevation view in cross-section of another side channel pump constructed in accordance with a preferred embodiment of the subject application, which includes a single journal bearing for supporting the rotor, two thrust bearings for axially positioning the rotor, a wave washer, an impeller shroud, and an inlet post, wherein fluid is supplied radially to the interior chamber and discharged radially therefrom.
Figure 5:
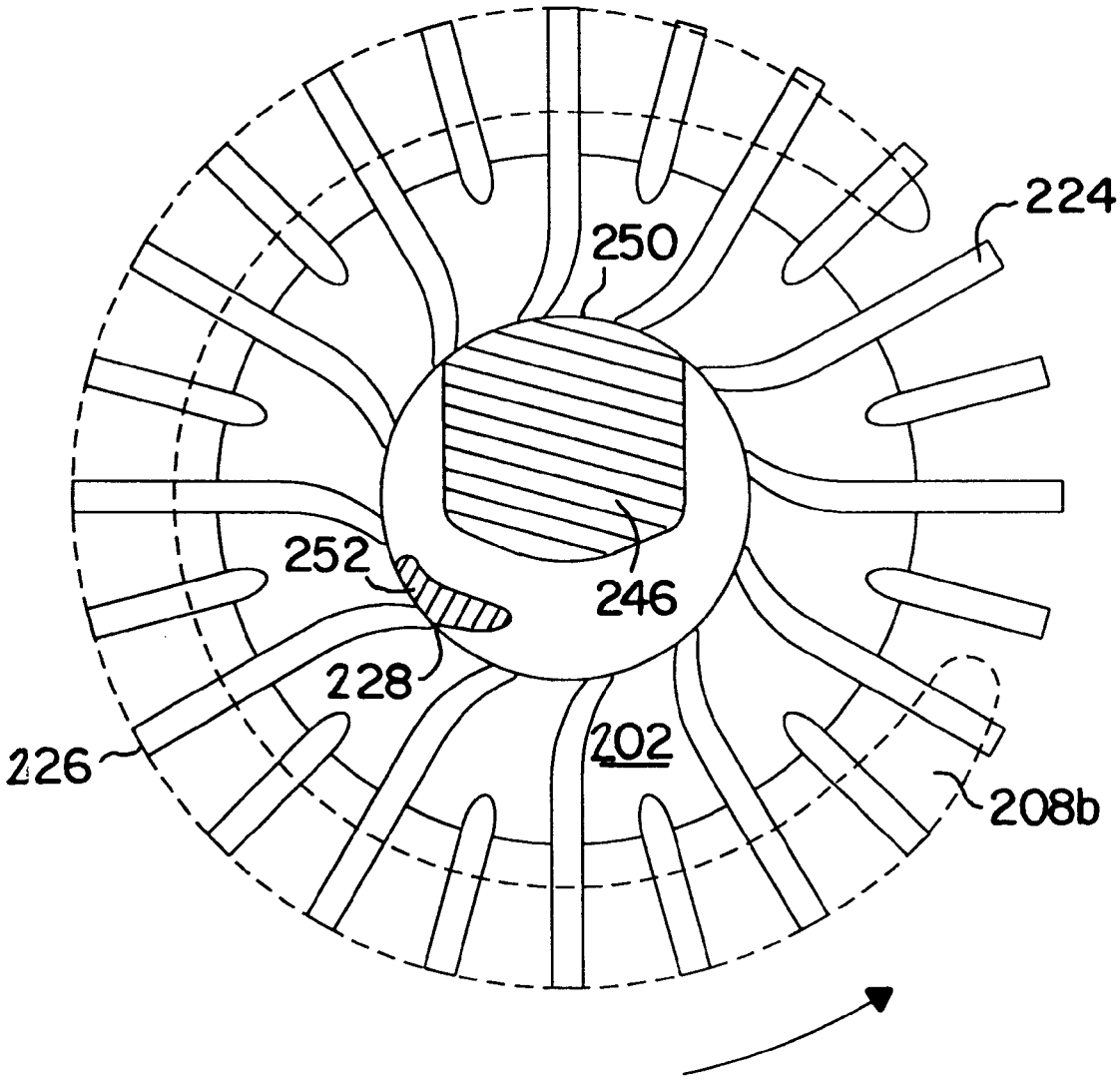
FIG. 5 is a cross-sectional view taken along line 5—5 of FIG. 4 illustrating spaced apart radial vane elements of the rotor member, an inlet passage and discharge passage extending through a inlet post member, and an arcuate channel extending about the pump axis.

Referring now to FIGS. 4 and 5, there is illustrated a fuel pump constructed in accordance with another embodiment of the subject application and designated generally by reference number 200. Fuel pump 200 is a side channel pump. However, those skilled in the art will readily appreciate that the inventive aspects can be applied to other close clearance type pumping configurations, such as, for example a centrifugal or liquid ring pump.

Fuel pump 200 includes a pump housing 210 having an interior chamber 202 and a discharge port 204. The interior chamber 202 defines a central axis 206 and laterally opposed arcuate channels 208*a* and 208*b* which extend about the central axis 206. Fuel pump 200 also includes a rotor member 220 and an inlet post member 240. Rotor member 220 is mounted for rotational movement within interior chamber 202 about central axis 206. The rotor member has a main body portion 222 that includes circumferentially spaced apart radial vane elements 224. Each vane element 224 has a radially inner base portion 228 and a radially outer tip portion 226. The rotor member 220 also includes a mounting portion 230 supporting the rotor member 220 within the interior chamber 202. Preferably, mounting portion 230 has an axial discharge passage 231 that extends therethrough.

Preferably, inlet post member 240 is supported within pump housing 210 and has opposed first and second end portions 242 and 244. Inlet post member 240 defines an inlet passage 246 and an outlet passage 252. Inlet passage 246 extends between inlet port 248, which is associated with the first end portion 242, and a radial discharge port 250, that is associated with the second end portion 244. Outlet passage 252 is associated with the second end portion 244 and extends between radial intake port 254 and axial discharge port 256.

In operation, fluid is admitted into the inlet passage 242 and is supplied initially along central axis 206. Then the fluid is delivered radially at a first pressure to interior chamber 202 of the pump housing 210 at the base portion 228 of the vane elements 224. Rotation of the rotor member 220, which is effectuated by drive shaft 290 coupled thereto, increases the pressure of the fluid disposed within interior chamber 202. Therefore, fluid exists pump housing 210 at a second pressure through outlet passage 252 which is in fluid connectivity with discharge port 204.

Fuel pump 200 further includes a journal bearing 260, as well as first and second axial thrust bearings 262*a* and 262*b*. Journal bearing 260 is operatively associated with mounting portion 230 for supporting for rotor member 220. First and second axial thrust bearings 262*a* and 262*b* are disposed within the interior chamber 202 for maintaining the axial position of the rotor member within the interior chamber of the pump housing. Additionally, circumferential biasing mechanism 270 is disposed within the interior chamber 202 of the pump housing 210 for biasing the first axial thrust bearing 262*b* towards rotor member 220. This facilitates axial alignment of rotor member 220. Preferably, at least one shim element 272 is utilized to adjust the biasing force applied by the circumferential biasing mechanism 270.

This disclosure addresses the aforementioned problems encountered with conventional close clearance type pump configurations by utilizing a reduced diameter journal bearing which falls well below the diameter of the inlet flow area. It is accomplished by taking substantially all of the radial load produced by the pumping element on only one side of rotor member 220, and eliminating the opposed second journal bearing that is used in conventional bearing configurations, as illustrated in the prior art pump shown in FIG. 1. As a result, there is greater access to the interior chamber of the pump housing on the side of the pump which does not have a journal bearing.

This configuration however, creates an unbalanced loading condition, which is restored by the first and second axial thrust bearings 262*a* and 262*b*. More particularly, the second axial thrust bearing 262*b* is biased toward the rotor by biasing element 270 in such a manner so as to overcome the bending moment produced by the eccentricity of load. The axial thrust load induced by biasing element 270 forces the rotor member 220 into engagement with first axial thrust bearing 262*a*, and thus defines the axial location of rotor member 220.

In this embodiment, the mounting portion 230 is located on the discharge side of fuel pump 200, while the inlet side is free to ride without a bearing in the radial direction. Preferably, circumferential biasing mechanism 270 is sized to react out the entire moment produced by the offset load. Rotor member 220 achieves complete static equilibrium through the combined reactions of the journal bearing 260 and the first and second axial thrust bearings 262*a* and 262*b*. Thus, rotor member 220 is free to rotate between the closely fitted radial discharge port 250 with only the variation of the bearing clearances themselves, which are minimal due to the small sizing of journal bearing 260.

With continuing reference to FIG. 4, circular plate member 280 is axially mounted for movement within interior chamber 202 of the pump housing 210. The plate member 280 is disposed between the rotor member 220 and the second axial thrust bearing 262*b* and is adapted to restrict the flow of fluid within interior chamber 102. Circular plate member 280 acts as a shroud thereby improving air pumping performance by reducing pump losses.

While the invention has been described with respect to preferred embodiments, those skilled in the art will readily appreciate that various changes and/or modifications can be made to the invention without departing from the spirit or scope of the invention as defined by the appended claims.

What is claimed is:

1. A fuel pump comprising:

a) a pump housing having an interior chamber and a discharge port, the interior chamber defining a central axis for the pump and laterally opposed arcuate channels extending about the central axis;

b) a rotor member mounted for rotational movement within the interior chamber of the pump housing about the central axis thereof, the rotor member having a main body portion that includes circumferentially spaced apart radial vane elements, each vane element having a radially inner base portion and a radially outer tip portion, and a mounting portion supporting the rotor member within the interior chamber; and c) an inlet post member supported within the pump housing, having opposed first and second end portions and defining an inlet passage extending between an inlet port associated with the first end portion and a radial discharge port associated with the second end portion, wherein fluid admitted into the inlet port is delivered at a first pressure radially to the interior chamber of the pump housing at the base portion of the vane elements, such that rotation of the rotor member within the interior chamber about the inlet post member increases the pressure of the fluid disposed within the interior chamber, and the fluid exits the discharge port of the pump housing at a second pressure.

2. The fuel pump as recited in claim 1, wherein the discharge port of the rotor housing extends axially from the interior chamber and is offset from the central axis of the pump.

3. The fuel pump as recited in claim 1, further comprising a journal bearing operatively associated with the mounting portion for supporting the rotor member within the pump housing.

4. The fuel pump as recited in claim 3, further comprising opposed first and second axial thrust bearings disposed within the interior chamber of the pump housing for maintaining the axial position of the rotor member within the interior chamber of the pump housing.

5. The fuel pump as recited in claim 4, further comprising biasing means disposed within the interior chamber of the pump housing for biasing the first axial thrust bearing towards the rotor member so as to promote static equilibrium within the pump housing.

6. The fuel pump as recited in claim 5, wherein the biasing means comprises an annular wave washer.

7. The fuel pump as recited in claim 5, wherein the biasing means further includes at least one shim element for adjusting a biasing force applied by the biasing means.

8. The fuel pump as recited in claim 1, further comprising a circular plate member axially mounted between the main body portion of the rotor member and the first axial thrust bearing to restrict the flow of the fluid within the interior chamber of the pump housing.

9. The fuel pump as recited in claim 1, wherein a running clearance exists between the inlet post member and the rotor member.

10. A fuel pump comprising:

a) a pump housing having an interior chamber and a discharge port, the interior chamber defining a central axis for the pump and laterally opposed arcuate channels extending about the central axis;

b) a rotor member mounted for rotational movement within the interior chamber of the pump housing about the central axis thereof, the rotor member having a main body portion that includes circumferentially spaced apart radial vane elements, each vane element having a radially inner base portion and a radially outer tip portion, and a mounting portion supporting the rotor member within the interior chamber, the mounting portion having an axial discharge passage extending therethrough; and c) an inlet post member supported within the pump housing, having opposed first and second end portions and defining an inlet passage and a outlet passage, the inlet passage extending between an inlet port associated with the first end portion and a radial discharge port associated with the second end portion, the outlet passage being associated with the second end portion and extending between a radial intake port and an axial discharge port, wherein fluid admitted into the inlet port is delivered at a first pressure radially to the interior chamber of the pump housing at the base portion of the vane elements, such that rotation of the rotor member within the interior chamber about the inlet post member increases the pressure of the fluid within the interior chamber, and fluid exists the discharge port of the pump housing through the outlet passage at a second pressure.

11. The fuel pump as recited in claim 10, further comprising a journal bearing operatively associated with the mounting portion for supporting the rotor member within the pump housing.

12. The fuel pump as recited in claim 11, further comprising opposed first and second axial thrust bearings disposed within the interior chamber of the pump housing for maintaining the axial position of the rotor member within the interior chamber of the pump housing.

13. The fuel pump as recited in claim 11, further comprising biasing means disposed within the interior chamber of the pump housing for biasing the first axial thrust bearing towards the rotor member so as to promote static equilibrium within the pump housing.

14. The fuel pump as recited in claim 13, wherein the biasing means comprises an annular wave washer.

15. The fuel pump as recited in claim 13, wherein the biasing means further includes at least one shim element for adjusting a biasing force applied by the biasing means.

16. The fuel pump as recited in claim 10, further comprising a circular plate member disposed between the main body portion of the rotor member and the first axial thrust bearing to restrict the flow of the fluid within the interior chamber of the pump housing.

17. The fuel pump as recited in claim 10, wherein a running clearance exists between the inlet post member and the rotor member.

18. A fuel pump comprising:

a) a pump housing having a interior chamber and a discharge port, the interior chamber defining a central axis for the pump;

b) a rotor member mounted for rotational movement within the interior chamber of the pump housing about the central axis thereof, the rotor member having a main body portion that includes circumferentially spaced apart radial vane elements, each vane element having a radially inner base portion and a radially outer tip portion, and a mounting portion for supporting the rotor member within the interior chamber;

c) a journal bearing disposed within the pump housing and operatively associated with the mounting portion for supporting the rotor member in a cantilevered manner;

d) opposed first and second axial thrust bearings disposed within the interior chamber of the pump housing for maintaining the axial position of the rotor member within the interior chamber of the pump housing; and e) biasing means disposed within the interior chamber of the pump housing for biasing the first axial thrust bearing towards the rotor member so as to promote static equilibrium within the pump housing by restoring a moment force imparted by the cantilevered mounting portion of the rotor member.

19. The fuel pump as recited in claim 18, wherein the biasing means comprises an annular wave washer.

20. The fuel pump as recited in claim 18, wherein the biasing means further includes at least one shim element for adjusting a biasing force applied by the biasing means.

21. The fuel pump as recited in claim 18, further comprising a circular plate member operatively associated with the rotor member and the first axial thrust bearing to restrict the flow of the fluid within the interior chamber of the pump housing.

22. A fuel pump comprising:

a) a pump housing having an interior chamber and a discharge port, the interior chamber defining a central axis for the pump and laterally opposed arcuate channels extending about the central axis;

b) an impeller mounted for rotational movement within the interior chamber of the pump housing about the central axis thereof, the impeller having a main body portion that includes circumferentially spaced apart radial blades, each blade having a radially inner base portion and a radially outer tip portion, and a cantilevered cylindrical extension portion supporting the impeller within the interior chamber, the cantilevered cylindrical extension portion having an axial discharge passage extending therethrough;

c) an inlet post member supported within the pump housing, having opposed first and second end portions and defining an inlet passage and a outlet passage, the inlet passage extending between an inlet port associated with the first end portion and a radial discharge port associated with the second end portion, the outlet passage being associated with the second end portion and extending between a radial intake port and an axial discharge port, wherein fluid admitted into the inlet port is delivered at a first pressure radially to the interior chamber of the pump housing at the base portion of the blades, such that rotation of the impeller about the inlet post within the interior chamber increases the pressure of the fluid within the interior chamber, and the fluid exists the pump housing from the discharge port through the outlet passage at a second pressure;

d) a journal bearing disposed within the pump housing and operatively associated with the cantilevered extension portion for supporting the impeller within the pump housing;

e) opposed first and second axial thrust bearings disposed within the interior chamber of the pump housing for maintaining the axial position of the impeller within the interior chamber of the pump housing;

f) biasing means disposed within the interior chamber of the pump housing for biasing the first axial thrust bearing toward the impeller so as to promote static equilibrium within the pump housing by restoring a moment force imparted by the cantilevered extension portion of the rotor member; and g) means for adjusting a biasing force applied by the biasing means.

23. The fuel pump as recited in claim 22, further comprising a circular plate member axially mounted between the main body portion of the impeller and the first axial thrust bearing to restrict the flow of the fluid within the interior chamber of the pump housing.

24. The fuel pump as recited in claim 22, wherein a running clearance exists between the inlet post member and the impeller.

25. The fuel pump as recited in claim 22, wherein the biasing means comprises an annular wave washer.

26. The fuel pump as recited in claim 22, wherein the means for adjusting the biasing force applied by the biasing means comprises at least on shim element.

* * * * *